US006832930B2

(12) United States Patent
Kubota et al.

(10) Patent No.: US 6,832,930 B2
(45) Date of Patent: Dec. 21, 2004

(54) METHOD OF ARRANGING CIRCUIT MEMBERS OF ELECTRIC CONNECTION BOX AND CIRCUIT MEMBER-ARRANGING STRUCTURE USING ARRANGING METHOD

(75) Inventors: Katuhiro Kubota, Shizuoka (JP); Hiroyuki Murakoshi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 45 days.

(21) Appl. No.: 10/296,820

(22) PCT Filed: Nov. 19, 2001

(86) PCT No.: PCT/JP01/10085

§ 371 (c)(1),
(2), (4) Date: Nov. 27, 2002

(87) PCT Pub. No.: WO02/43188

PCT Pub. Date: May 30, 2002

(65) Prior Publication Data

US 2003/0124906 A1 Jul. 3, 2003

(30) Foreign Application Priority Data

Nov. 22, 2000 (JP) ..... 2000-356596

(51) Int. Cl.[7] ..... H01R 4/24
(52) U.S. Cl. ..... 439/404
(58) Field of Search ..... 439/404, 76.2

(56) References Cited

U.S. PATENT DOCUMENTS 5,421,741 A 6/1995 David et al. ..... 439/405
5,478,244 A 12/1995 Maue et al. ..... 439/76.2
5,501,605 A * 3/1996 Ozaki et al. ..... 439/34
5,509,196 A 4/1996 Davis et al. ..... 29/830
5,722,851 A * 3/1998 Onizuka et al. ..... 439/404
5,777,850 A * 7/1998 Jakob et al. ..... 361/736
5,782,651 A * 7/1998 Konoya ..... 439/405
5,920,034 A * 7/1999 Saka et al. ..... 174/59
6,541,700 B2 * 4/2003 Chiriku et al. ..... 174/50

OTHER PUBLICATIONS

International Search Report, Mar. 2002.

* cited by examiner

*Primary Examiner*—Tulsidas C. Patel
(74) *Attorney, Agent, or Firm*—Sughrue Mion, PLLC

(57) ABSTRACT

There are provided a circuit member-overlapping step of overlapping a plurality of flexible flat circuit members 20A and 20B in intersecting relation to each other (each of the flat circuit members comprising a plurality of conductors 21 which are juxtaposed at predetermined intervals, and are covered with a covering member 22 in an insulating manner), an internal equipment portion-assembling step of connecting electric parts 30, such as a connector block 31, a fuse block 32 and an electronic board 33, respectively to arbitrary portions of the overlapped flat circuit members 20A and 20B, and an internal equipment portion-inserting step of curling the flat circuit members 20A and 20B and inserting them into a casing 13 while positioning the electric parts 30 relative to the casing 13.

18 Claims, 10 Drawing Sheets

METHOD OF ARRANGING CIRCUIT MEMBERS OF ELECTRIC CONNECTION BOX AND CIRCUIT MEMBER-ARRANGING STRUCTURE USING ARRANGING METHOD

TECHNICAL FIELD

This invention relates to a method of arranging circuit members of an electric connection box which can be formed by flexible flat circuit members, such as a wire harnesses, without the use of a wiring board, and the invention also relates to a circuit member-arranging structure using this arranging method.

BACKGROUND ART

Examples of conventional electric connection boxes include one which was proposed by the Applicant of the present application, and is disclosed in Unexamined Japanese Utility Model Publication Hei. 7-9023. In this electric connection box 1, bus bars 2 and wires 3, forming a circuit, are insulated by wiring boards 4 in each layer, as shown in FIG. 12. In this case, two (upper and lower) boards 4*a* and 4*b* are provided as the wiring boards 4, and the bus bars 2 are mounted on the lower board 4*b* while the wires 3 are mounted on the upper board 4*a*. Press-connecting terminals 5 for connection to connectors are fixedly mounted on the upper board 4*a*, and the wires 3 are press-connected to these press-connecting terminals 5, and the press-connecting terminals 5 are press-fitted into the bus bars 2 mounted on the lower board 4*b*, thus forming an internal equipment portion. This internal equipment portion is covered with a main cover 6 and an under cover 7, thereby forming the electric connection box 1.

In the above conventional electric connection box 1, however, it is a common practice to automatically mount the bus bars 2, the wires 3 and other electric parts on the plurality of wiring boards 4, using a wiring machine, and particularly the wiring structure of the wires 3 becomes complicated, and besides the number of the component parts increases, so that the assembling procedure becomes complicated. Therefore, an assembling installation becomes bulky, and as a result the cost of the product becomes high.

DISCLOSURE OF INVENTION

It is therefore an object of this invention to provide a method of arranging circuit members of an electric connection box, as well as a circuit member-arranging structure using this arranging method, in which an assembling operation can even be effected manually by simplifying the structure of an internal equipment portion, thereby reducing an installation cost.

According to the present invention, there is provided a method of arranging circuit members of an electric connection box, characterized by:

- a circuit member-overlapping step of overlapping a plurality of flexible flat circuit members in intersecting relation to each other, each of the flat circuit members comprising a plurality of conductors which are juxtaposed at predetermined intervals, and are covered with a covering member in an insulating manner;
- an internal equipment portion-assembling step of connecting electric parts, such as a connector block, a fuse block and an electronic board, respectively to arbitrary portions of the overlapped flat circuit members; and
- an internal equipment portion-inserting step of curling the flat circuit members and inserting them into a casing while positioning the electric parts relative to the casing.

In this electric connection box circuit member-arranging method, the plurality of flexible flat circuit members, each including the plurality of conductors covered with the covering member, are overlapped, and by doing so, the multilayer circuit construction is simplified. The plurality of overlapped flat circuit members intersect each other, and by doing so, the layout of the electric parts, connected to these flat circuit members, can be effected easily. And besides, the plurality of flat circuit members, intersecting each other, are flexible, and therefore these flat circuit members, having the electric parts connected thereto, can be easily curled and inserted into the casing. Thus, the circuit construction of the internal equipment portion is simplified, and therefore the operation for overlapping the flat circuit members, the operation for connecting the electric parts, and the operation for inserting the internal equipment portion into the casing can be effected easily not only by an assembling apparatus but also by a manually-assembling operation.

In the electric connection box circuit member-arranging method of the invention, arbitrary ones of the conductors of the overlapped flat circuit members are connected together at their intersecting portions.

In this electric connection box circuit member-arranging method, the arbitrary conductors of the overlapped flat circuit members can be directly connected together, and therefore there is no need to use a connector and connection terminals.

In the electric connection box circuit member-arranging method of the invention, press-connecting terminals are fixedly secured to each of the electric parts, and the conductors of the flat circuit members are press-connected to the press-connecting terminals.

In this electric connection box circuit member-arranging method, the connection between the flat circuit member and the electric part can be made merely by press-connecting the conductors of the flat circuit member to the press-connecting terminals, and therefore this connecting operation can be effected easily and positively.

According to the invention, there is provided a structure of arranging circuit members of an electric connection box, characterized in that there are provided a plurality of flexible flat circuit members each comprising a plurality of conductors which are juxtaposed at predetermined intervals, and are covered with a covering member in an insulating manner, and the flat circuit members are overlapped in intersecting relation to each other, and electric parts, such as a connector block, a fuse block and an electronic board, are connected respectively to arbitrary portions of the overlapped flat circuit members, and the flat circuit members are curled, and are inserted into a casing while positioning the electric parts relative to the casing.

In this electric connection box circuit member-arranging structure, the plurality of flexible flat circuit members, each including the plurality of conductors covered with the covering member, are overlapped, and by doing so, the use of conventional wiring boards can be eliminated, so that the construction can be simplified. The plurality of overlapped flat circuit members intersect each other, and by doing so, the layout of the electric parts, connected to these flat circuit members, can be effected easily. And besides, the plurality of flat circuit members, intersecting each other, are flexible, and therefore these flat circuit members, having the electric parts connected thereto, can be easily curled and inserted into the casing, so that the compact design of the overall construction can be achieved. Furthermore, when the electric parts are beforehand provided at mounting holes and retaining portions of the casing, the fixing of these electric parts can be effected easily even by a manually-assembling operation. Furthermore, since the wiring structure is formed by the flat circuit members, the arbitrary circuit can be easily changed according to a program.

According to the invention, there is provided a structure of arranging circuit members of an electric connection box, characterized in that there are provided a plurality of flexible flat circuit members each comprising a plurality of conductors which are juxtaposed at predetermined intervals, and are covered with a covering member in an insulating manner, and the flat circuit members are overlapped in intersecting relation to each other, and the overlapped portions of the flat circuit members are received in a casing, and an arbitrary end of each flat circuit member is extended outwardly from the casing, and the extension portion is extended to an auxiliary equipment which is to be connected to the extension portion.

In this electric connection box circuit member-arranging structure, the plurality of flexible flat circuit members, each including the plurality of conductors covered with the covering member, are overlapped, and by doing so, the use of conventional wiring boards can be eliminated, so that the construction can be simplified. And besides, the flat circuit member is extended from the casing to the mating auxiliary equipment, and therefore the use of wires, connecting the casing to the auxiliary equipment, and the use of a connector, connecting these wires to the casing, are omitted.

In the electric connection box circuit member-arranging structure of the invention, arbitrary ones of the conductors of the overlapped flat circuit members are connected together at their intersecting portions.

In this electric connection box circuit member-arranging structure, the arbitrary conductors of the overlapped flat circuit members can be directly connected together, and therefore there is no need to use a connector and connection terminals, and the connection structure is simplified, and the connection can be effected positively.

BEST MODE FOR CARRYING OUT THE INVENTION

Figure 1:
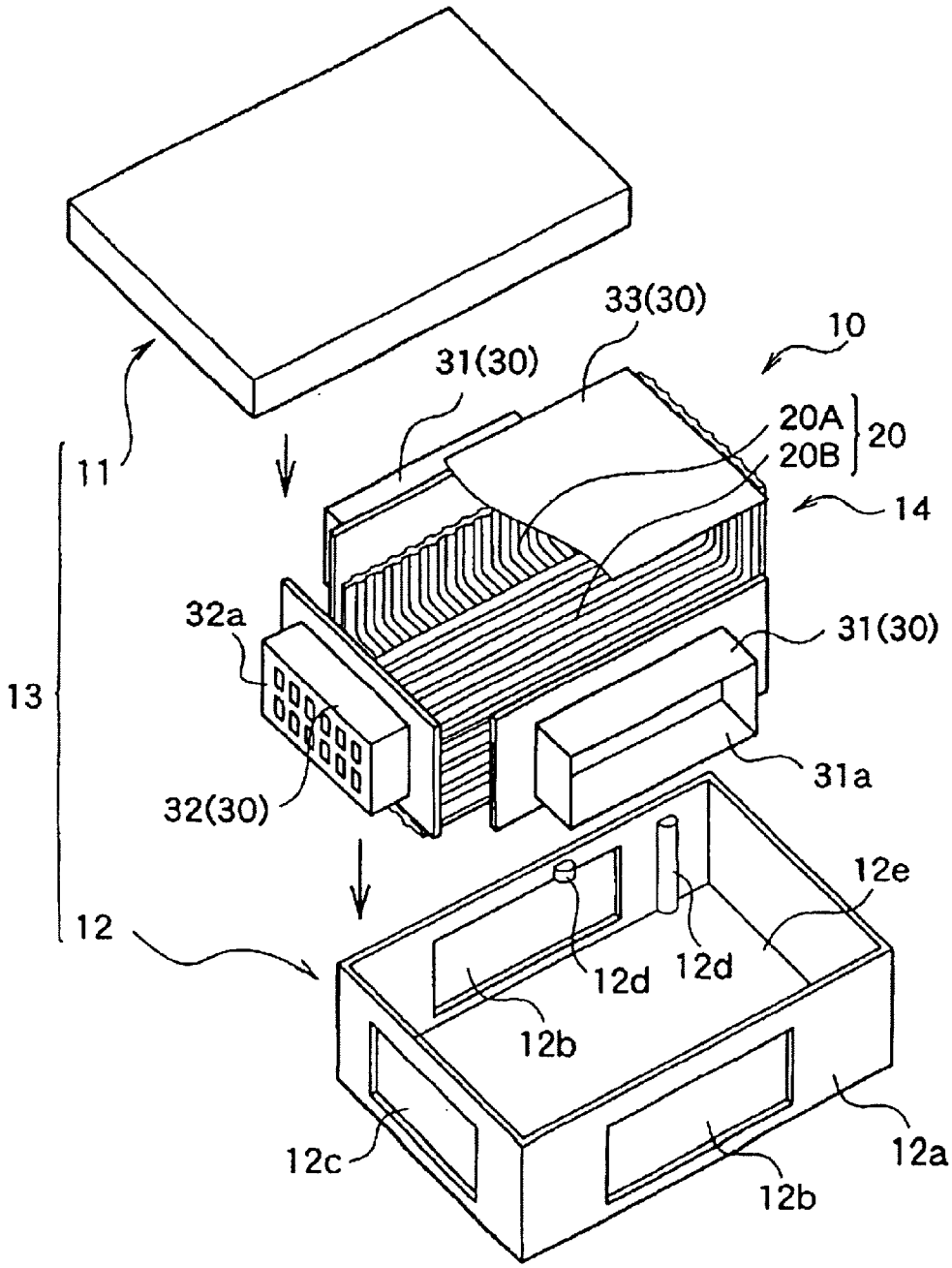
FIG. 1 is an exploded, perspective view of a first embodiment of an electric connection box of the invention.
Figure 2:
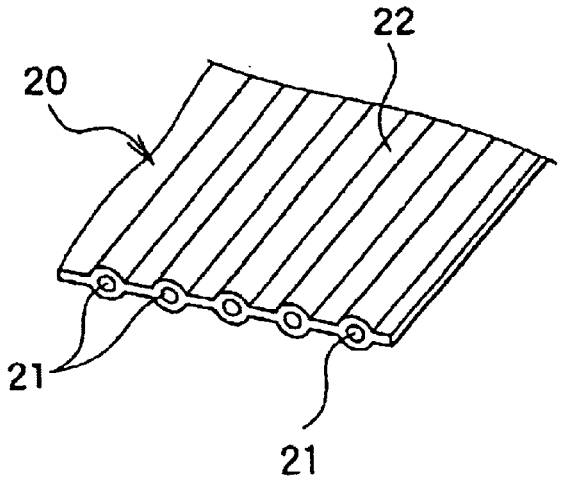
FIG. 2 is an enlarged, perspective view of important portions of flat circuit members, showing the first embodiment of the invention.
Figure 3:
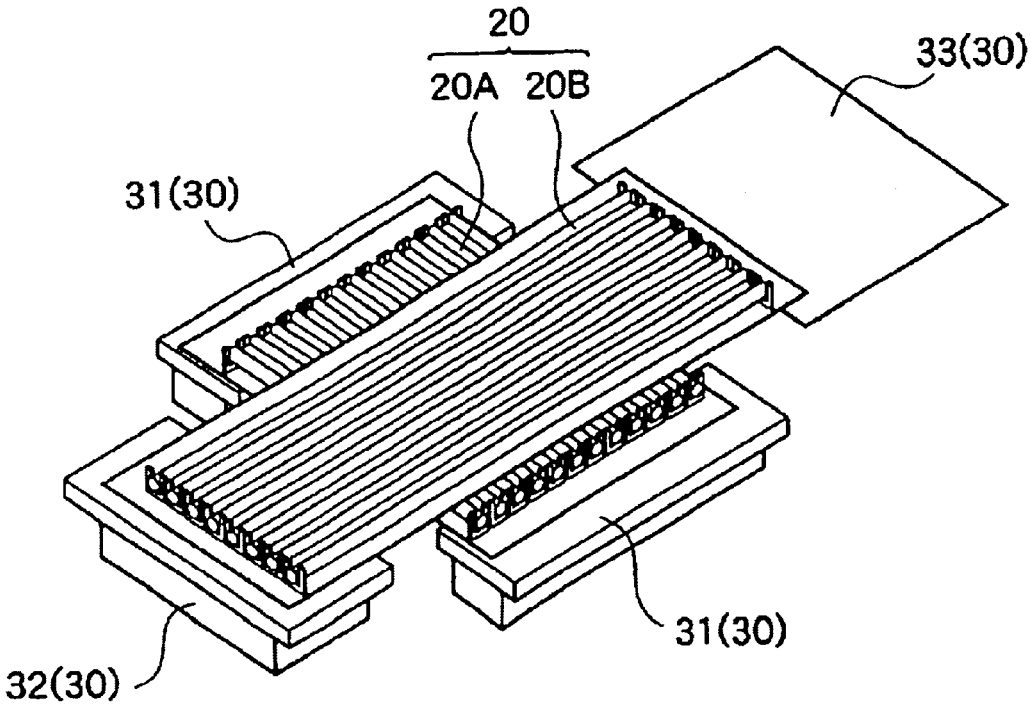
FIG. 3 is a perspective view of the flat circuit members, showing the first embodiment.

A preferred embodiment of the present invention will now be described in detail with reference to the accompanying drawings. FIGS. 1 to 6 show a method of arranging circuit members of an electric connection box, as well as a circuit member-arranging structure, provided in accordance with a first embodiment of the invention, and FIG. 1 is an exploded, perspective view of the electric connection box, FIG. 2 is an enlarged, perspective view of important portions of flat circuit members, FIG. 3 is a perspective view showing the flat circuit members in a taken-out condition, FIGS. 4(*a*) to (*c*) are perspective views sequentially showing a process of overlapping the flat circuit members, FIG. 5 is a perspective view showing a condition of connection of the flat circuit member to connectors, and FIGS. 6(*a*) and (*b*) are cross-sectional views sequentially showing a condition of inserting of the flat circuit member, having the connectors connected thereof, into a casing.

As shown in FIG. 1, the electric connection box 10 of this embodiment broadly comprises the casing 13, comprising an upper cover 11 and an under cover 12, and an internal equipment portion 14 received in an internal space of this casing 13. This internal equipment portion 14 comprises wiring groups, and in the circuit member-arranging structure of this embodiment, flat wire harnesses 20 are used as flat flexible circuit members, and as shown in FIG. 2, this flat wire harness 20 comprises a plurality of wires (conductors) 21, 21 . . . , juxtaposed at predetermined intervals, and a covering member 22 which is made of an insulative resin, and covers the plurality of wires 21, 21 . . . .

The flat wire harness 20 includes the plurality of wires 21, 21 . . . arranged straight in parallel relation to one another, and there are prepared two (first and second) flat wire harnesses 20A and 20B which are cut into their respective predetermined lengths, that is, cut according to longitudinal and transverse dimensions of the casing 13, as shown in FIG. 3. The first and second flat wire harnesses 20A and 20B overlap each other in perpendicularly-intersecting relation to each other in such a manner that the first flat wire harness 20A is disposed at the lower side (in the drawings) while the second flat wire harness 20B is disposed at the upper side. Electric parts 30 are connected to ends of these flat wire harnesses, respectively. In this embodiment, the electric parts 30, connected respectively to the opposite ends of the first flat wire harness 20A, are connector blocks 31, and the electric part, connected to one end of the second flat wire harness 20B, is a fuse block 32 while the electric part, connected to the other end thereof, is an electronic board 33.

The circuit member-arranging method of this embodiment for the electric connection box 10 of this construction comprises the circuit member-overlapping step of overlapping the first and second flat wire harnesses 20A and 20B in intersecting relation to each other, the internal equipment portion-assembling step of connecting the electric parts 30 (such as the connector blocks 31, the fuse block 32 and the electronic board 33) respectively to arbitrary portions of the overlapped first and second flat wire harnesses 20A and 20B, and the internal equipment portion inserting step of curling the first and second flat wire harnesses 20A and 20B and inserting them into the casing 13 while attaching the electric parts 30 to the casing 13.

Figure 4:
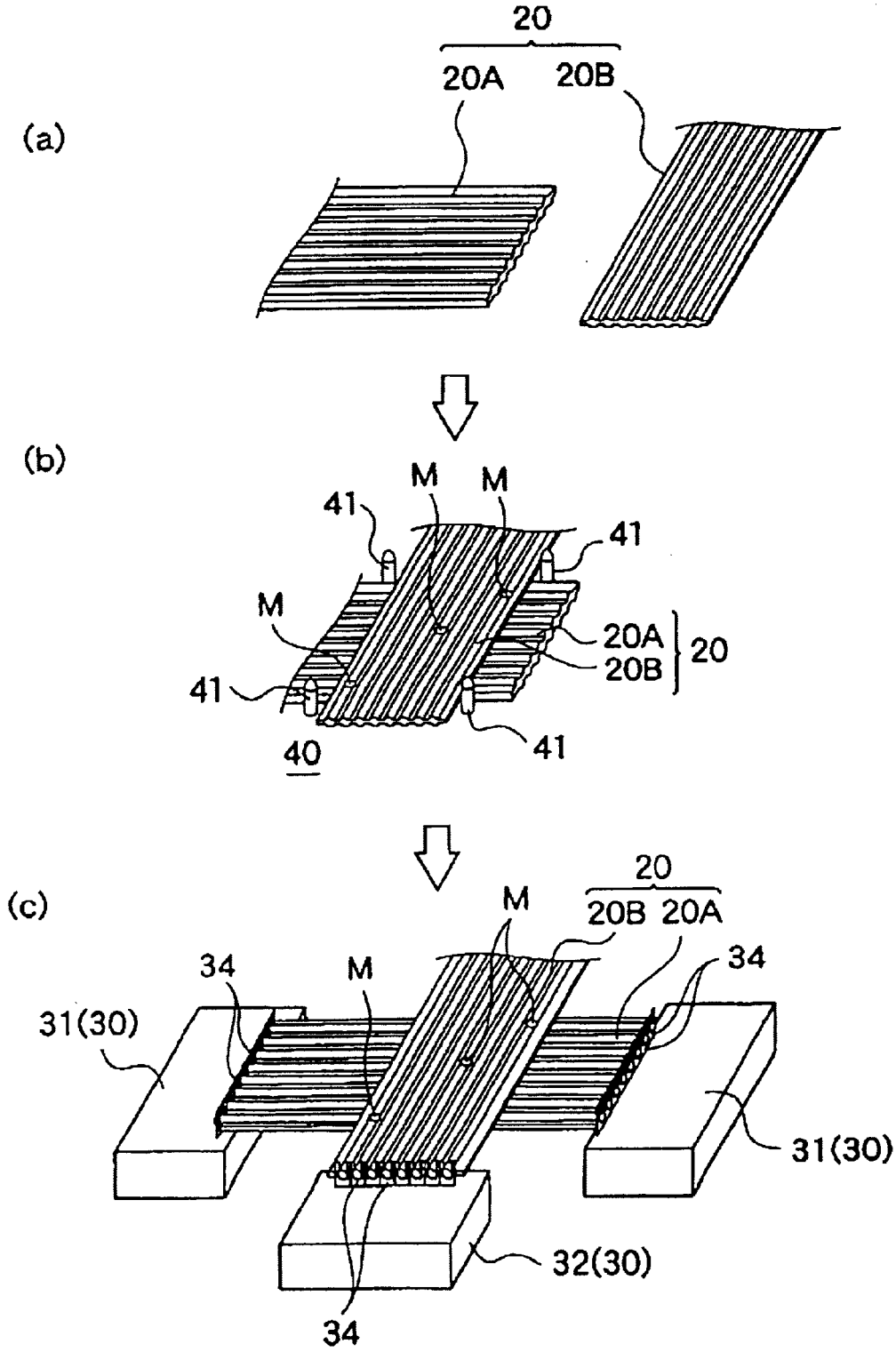
FIGS. 4(*a*) to (*c*) are perspective views sequentially showing a process of overlapping the flat circuit members, showing the first embodiment of the invention.
Figure 5:
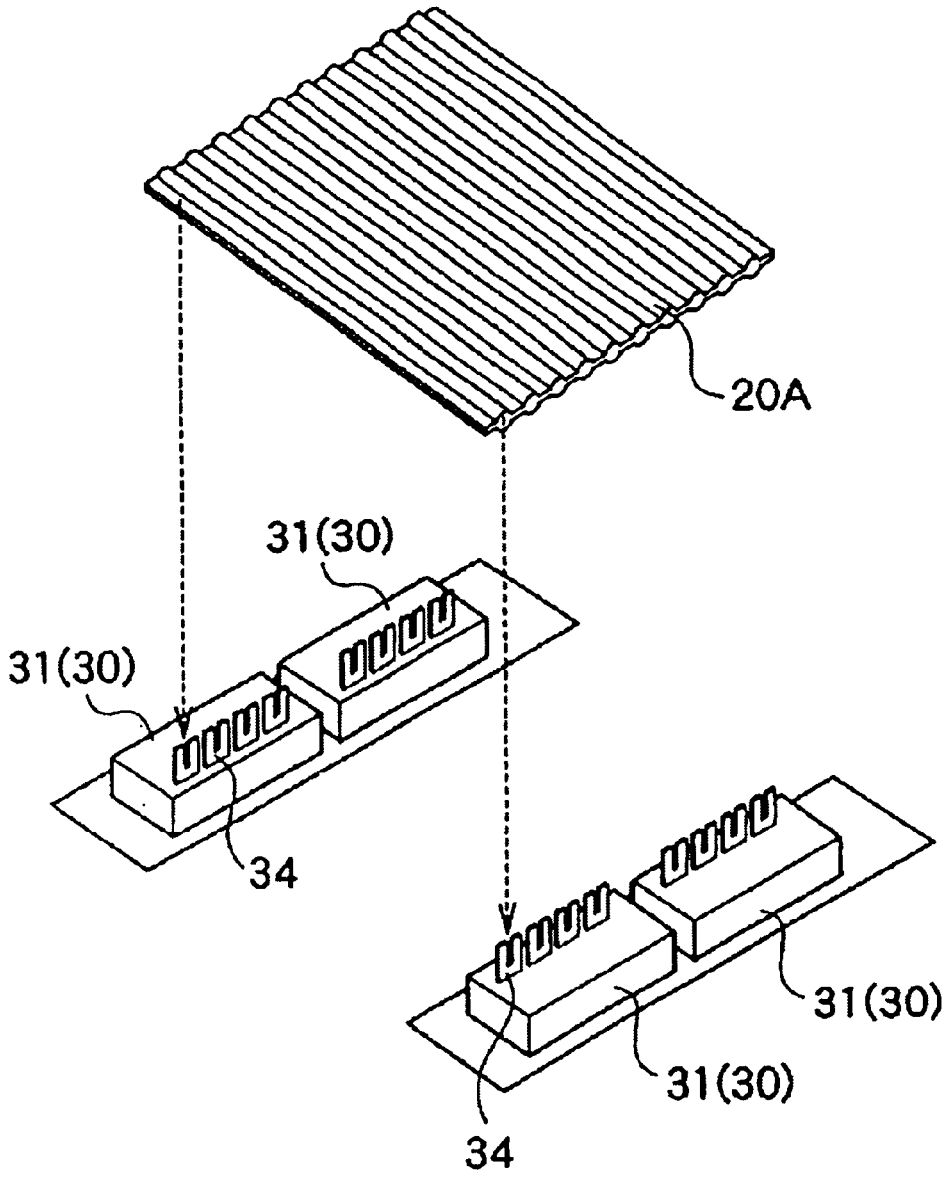
FIG. 5 is a perspective view showing a condition of connection of the flat circuit member of the first embodiment of the invention to connectors.

Namely, the first and second flat wire harnesses 20A and 20B are joined or connected together according to the procedure shown in FIGS. 4(*a*) to (*c*). First, the first and second flat wire harnesses 20A and 20B are cut into their respective predetermined lengths as shown in FIG. 4(*a*), and then, using a jig 40 having four pilot pins 41 extending upright respectively from predetermined portions thereof, the first and second flat wire harnesses 20A and 20B are overlapped in intersecting relation to each other between the pilot pins 41 of this jig 40, and are positioned relative to each other, as shown in FIG. 4(*b*).

Then, in this positioned condition of the first and second flat wire harnesses 20A and 20B, their intersecting portions are fused together at suitable points M as shown in FIG. 4(*b*). With this fusing operation at the point M, the arbitrary wires 21 of the first and second flat wire harnesses 20A and 20B can be connected together at their intersecting portions. For example, a molten electrically-conductive resin is applied to a spot on the intersecting portions of the wires 21, and melts the covering members 22 of these wires 21 by its heat, thereby exposing the overlapping wires 21, and the exposed wires 21 are integrally connected together by the applied electrically-conductive resin.

After the first and second flat wire harnesses 20A and 20B are thus connected together in perpendicularly-intersecting relation to each other, the electric parts 30, such as the connector blocks 31, the fuse block 32 and the electronic board 33, are connected to the ends of these flat wire harnesses, respectively, as shown in FIG. 4(*c*).

Figure 6:
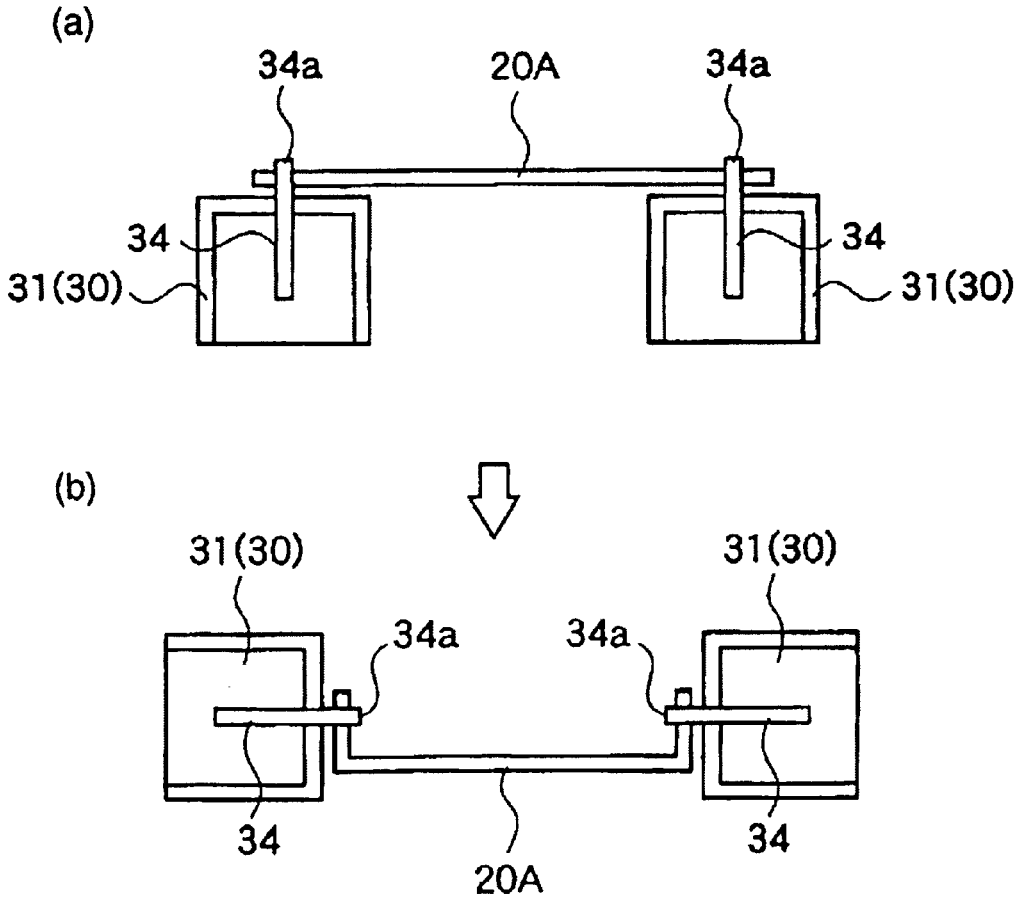
FIGS. 6(*a*) and (*b*) are cross-sectional views sequentially showing a condition of inserting of the flat circuit member of the first embodiment of the invention, having the connectors connected thereof, into a casing.

The connection of the electric parts 30 to the first and second flat wire harnesses 20A and 20B will be described, for example, with respect to the connection of the connector blocks 31 to the first flat wire harness 20A as shown in FIGS. 5 and 6(*a*). A necessary number of press-connecting terminals 34, 34 . . . are beforehand fixedly secured to the connector block 31 by insert-molding or press-fitting, with their press-connecting portions 34*a* projecting outwardly from this block. The connector blocks 31 are set in position, with the press-connecting portions 34*a* of the press-connecting terminals 34, 34 . . . directed upwardly, and then the first flat wire harness 20A is pressed toward these connector blocks from the upper side, thereby press-connecting the wires 21, 21 . . . to the corresponding press-connecting portions 34*a* of the press-connecting terminals 34, 34 . . . , respectively.

The method of connecting the connector blocks 31 to the first flat wire harness 20A can be applied to a method of connecting the fuse block 32 and the electronic board 33 to the second flat wire harness 20B. The opposite end portions of the first flat wire harness 20A, thus having the connector blocks 31 connected to the opposite ends thereof, are bent substantially perpendicularly in such a manner that insertion ports 31*a* of the connector blocks 31 are directed outwardly, as shown in FIG. 6(*b*).

As shown in FIG. 1, a pair of mounting holes 12*b* for the connector blocks 31 are formed respectively through opposed side portions of a side wall 12*a* of the bottom cover 12 of the casing 13, and a mounting hole 12*c* for the fuse block 32 is formed through that side portion of the side wall 12*a* disposed perpendicular to these opposed side portions. Step portions 12*d*, serving as retaining portions for retaining the electronic board 33, are formed on the inner surface of the opposed side portions, having the mounting holes 12*b*, at an open end portion of the bottom casing.

Then, the first flat wire harness 20A, having the connector blocks 31 connected thereto, and the second flat wire harness 20B, having the fuse block 32 and the electronic board 33 connected thereto, are bent and curled, and are inserted into the under cover 12 in such a manner that the insertion ports 31*a* of the connector blocks 31 and an insertion port portion 32*a* of the fuse block 32 are directed outwardly in parallel relation to a bottom surface 12*e* of the under cover 12 and that the electronic board 33 is inverted to be disposed in parallel relation to this bottom surface 12*e*. The connector blocks 31 are inserted respectively into the mounting holes 12*b* from the inner side, and similarly the fuse block 32 is inserted into the mounting hole 12*c* from the inner side, and the electronic board 33 is retained by the step portions 12*d*, and these parts are thus positioned. In this condition, the upper cover 11 is fixed to the under cover 12 to cover the open top thereof, thus completing the assemblage of the electric connection box 10 of this embodiment.

The operation of the electric connection box circuit member-arranging structure of this embodiment, having the above construction, will be described. The first and second flat wire harnesses 20A and 20B, each comprising the plurality of wires 21, 21 . . . covered with the covering member 22, are overlapped, and the connector blocks 31, the fuse box 32 and the electronic board 33 are connected to these flat wire harnesses to form the internal equipment portion 14. Therefore, a multi-layer circuit construction is provided by the overlapped first and second flat wire harnesses 20A and 20B, and the use of conventional wiring boards can be eliminated, and the construction is simplified since it is formed merely by overlapping the flat wire harnesses 20.

In this case, the arbitrary wires 21 of the overlapped flat wire harnesses 20A and 20B are fused together (as at M) at their intersecting portions, and therefore a connector and a connection terminal do not need to be used for connecting the wire 21, and therefore the connecting operation can be effected rapidly and positively, thereby enhancing the efficiency of production of the circuit.

The press-connecting terminals 34 are fixedly secured to the electric parts 30, and the wires 21, 21 . . . of the first and second flat wire harnesses 20A and 20B are press-connected to these press-connecting terminals 34, and therefore these connecting operations can be effected easily and positively. The overlapped first and second flat wire harnesses 20A and 20B perpendicularly intersect each other, and therefore the opposite end portions of the two flat wire harnesses 20A and 20B are spaced from one another in the peripheral direction around their intersecting portions, and therefore when attaching the connector blocks 31, the fuse block 32 and the electronic board 33, connected respectively to these ends, to the under cover 12, these electric parts will not interfere with each other, and the layout of these parts can be effected easily.

The first and second flat wire harnesses 20A and 20B, intersecting each other, are flexible, and therefore can be easily flexed. Each of the first and second flat wire harnesses 20A and 20B, having the electric parts connected thereto, can be easily curled, and therefore can be easily inserted into the casing 13, and the whole can be formed into a compact design.

Thus, in this embodiment, the internal equipment portion 14 has the simple construction in which the first and second flat wire harnesses 20A and 20B are overlapped in intersecting relation to each other, and the electric parts 30 are connected to the ends of these flat wire harnesses through the press-connecting terminals 34. The operation for joining the first and second flat wire harnesses 20A and 20B in overlapping relation, the operation for connecting the electric parts 30 to these wire harnesses, and the operation for inserting the internal equipment portion 14 into the casing 13 can be easily effected not only by an assembling apparatus but also by an manually-assembling operation. Therefore, when the manually-assembling operation is adopted, the assembling apparatus can be much simplified, and therefore the cost of the product can be reduced.

Figure 7:
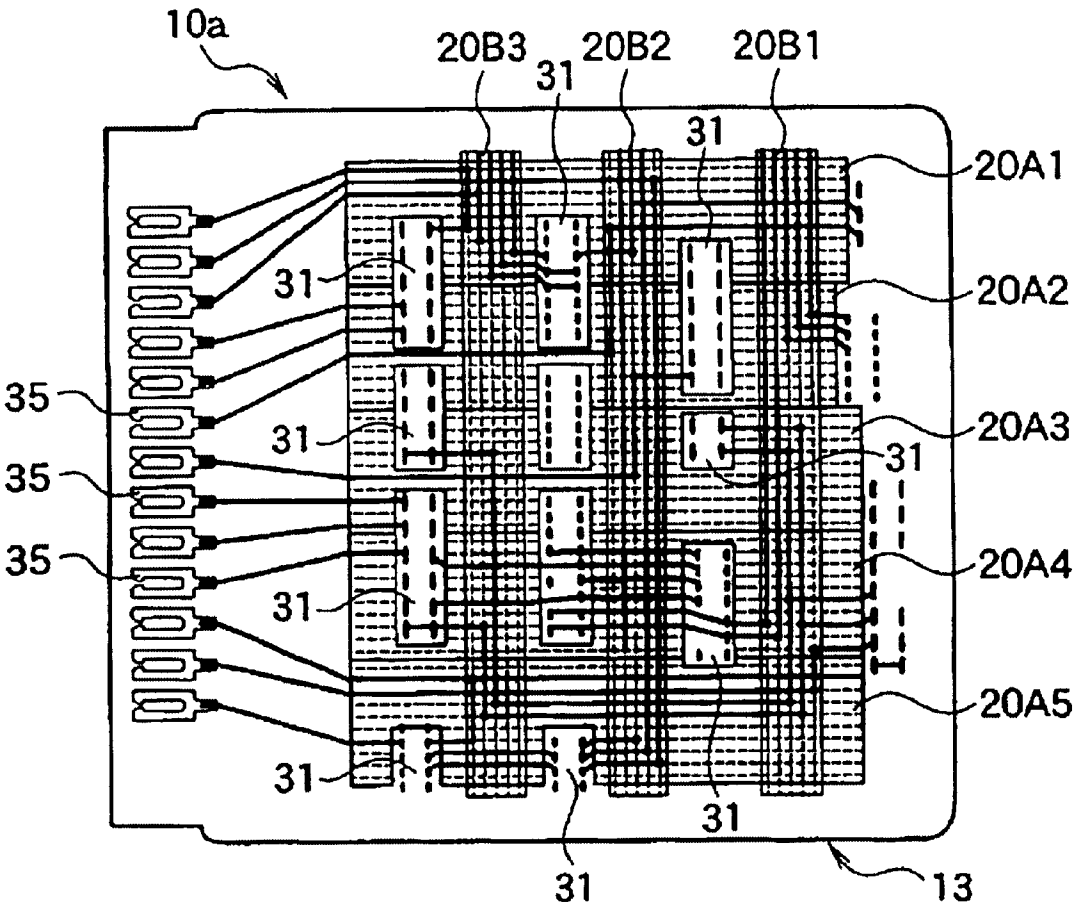
FIG. 7 is a plan view of a second embodiment of an electric connection box of the invention.
Figure 8:
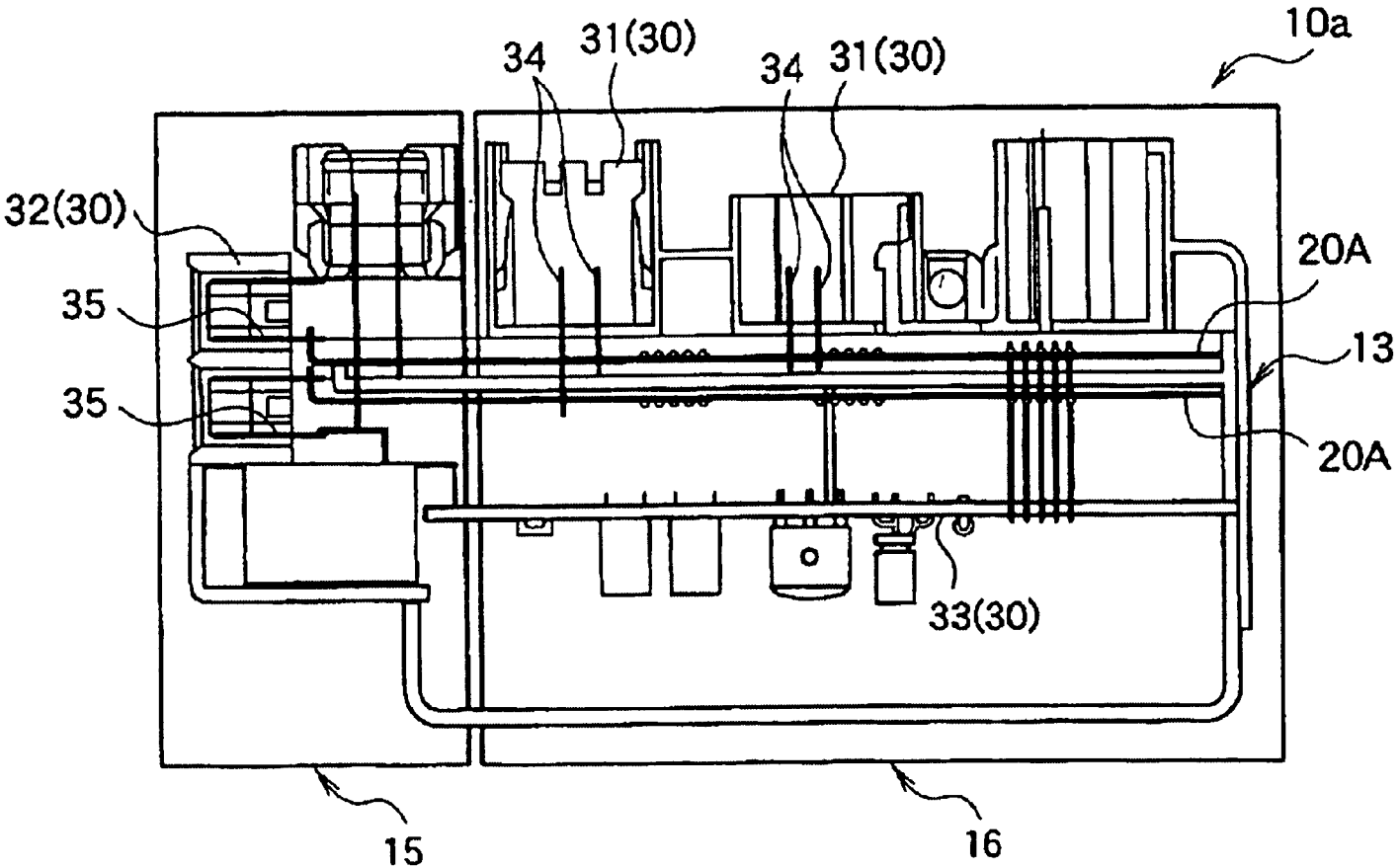
FIG. 8 is a side-elevational developed, cross-sectional view of the electric connection box of the second embodiment of the invention.

FIGS. 7 and 8 show a second embodiment of the invention, and those constituent portions, identical to those of the first embodiment, will be designated by identical reference numerals, respectively, and repeated description thereof will be omitted. FIG. 7 is a plan view of an electric connection box, and FIG. 8 is a side-elevational developed, cross-sectional view of the electric connection box. The electric connection box 10*a* of this second embodiment differs mainly from the electric connection box 10 of the first embodiment in that first flat wire harnesses 20A, as well as second flat wire harnesses 20B, are provided in a plurality of rows.

In the electric connection box 10*a* of this embodiment, the first flat wire harnesses 20A are defined by five flat wire harnesses 20A1, 20A2, 20A3, 20A4 and 20A5, and the second wire harnesses 20B are defined by three flat wire harnesses 20B1, 20B2 and 20B3, as shown in FIG. 7. The first and second flat wire harnesses 20A and 20B, thus arranged in the plurality of rows, are provided at each of two (upper and lower) stages, as shown in FIG. 8.

A shown in FIG. 8, the electric connection box 10*a* of this embodiment comprises a power source portion 15, which includes fuse blocks 32 for small-height fuses, and serves as a relay module, and a distribution portion 16 in which a plurality of connector blocks 31 and an electronic board 33 are provided. The first and second flat wire harnesses 20A and 20B of the two-stage construction, are arranged in this distribution portion 16. A plurality of press-connecting terminals 35, 35 . . . are provided at the power source portion 15, and the first and second flat wire harnesses 20A and 20B are connected to these press-connecting terminals 35, 35 . . . , thereby electrically connecting the power source portion 16 and the distribution portion 16 together. The connector blocks 31 are connected to intermediate portions of the first flat wire harnesses 20A through press-connecting terminals 34.

Therefore, this embodiment achieves similar effects as described above for the first embodiment, and besides a compact design of the electric connection box 10*a* can be achieved while much increasing the number of wires arranged in the electric connection box, since the first and second flat wire harnesses 20A and 20B are arranged in the plurality of rows at the plurality of stages.

Figure 9:
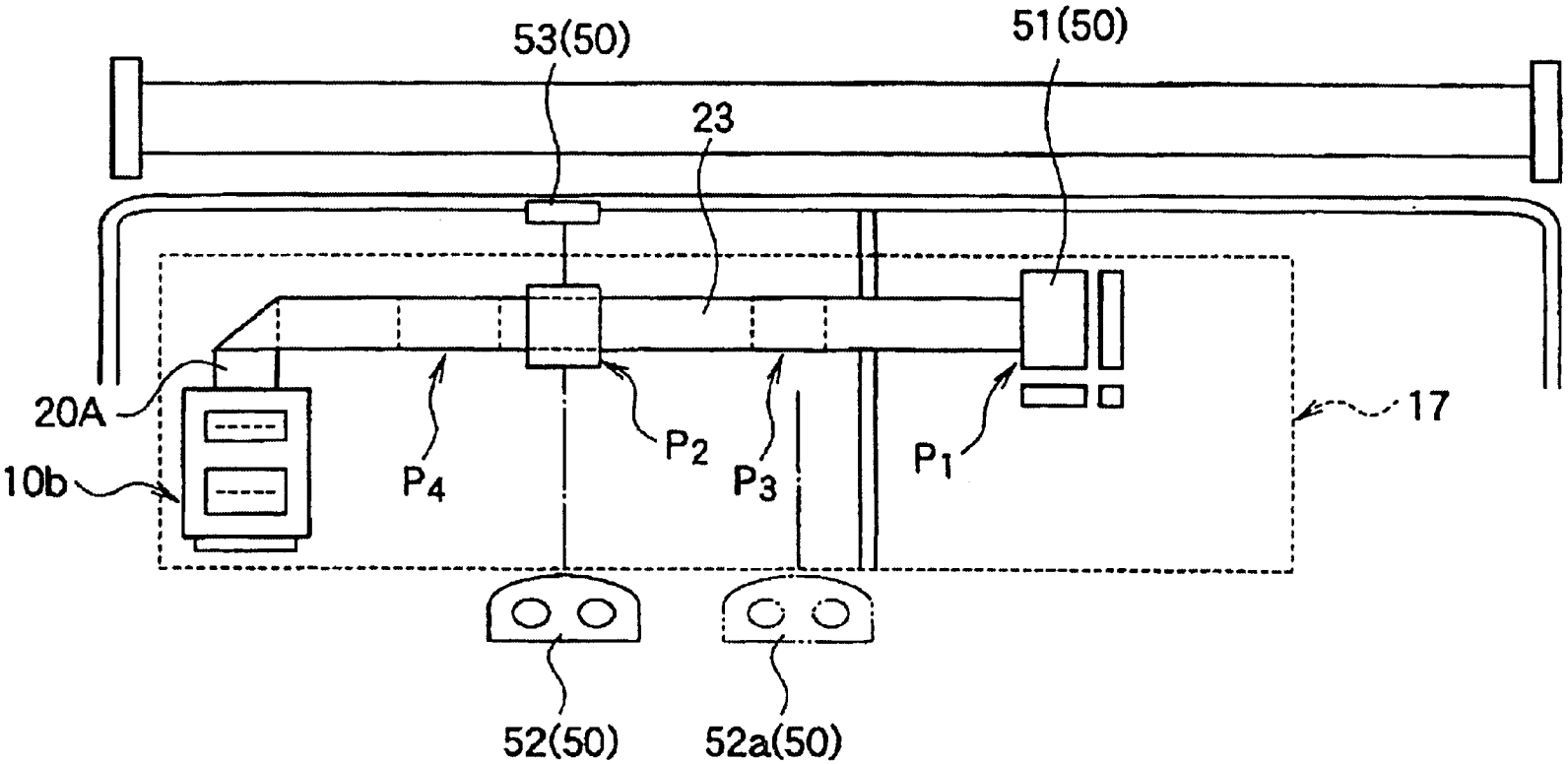
FIG. 9 is a view showing the arrangement of a flat wire extending outwardly from an electric connection box, showing a third embodiment of the invention.
Figure 10:
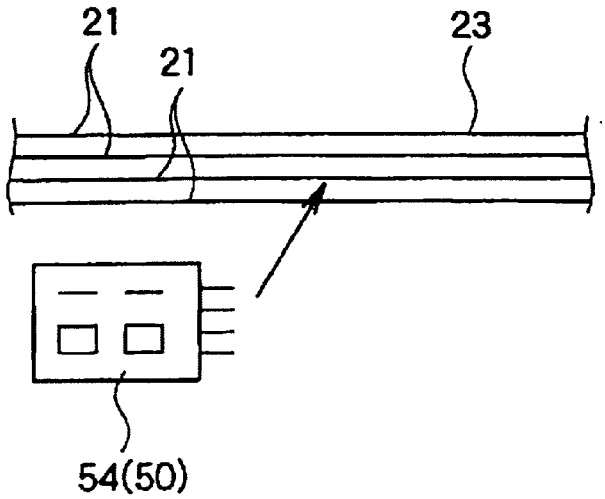
FIG. 10 is a view explanatory of an additional unit to be connected to an extension portion of the flat wire, showing the third embodiment of the invention.
Figure 11:
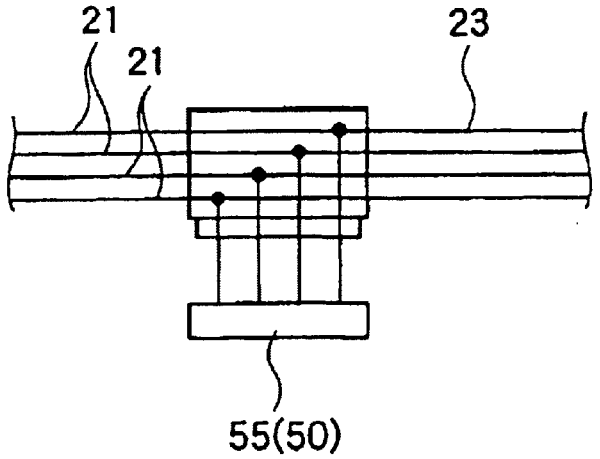
FIG. 11 is a diagram of a circuit branching off from the extension portion of the flat wire in the third embodiment of the invention.
Figure 12:
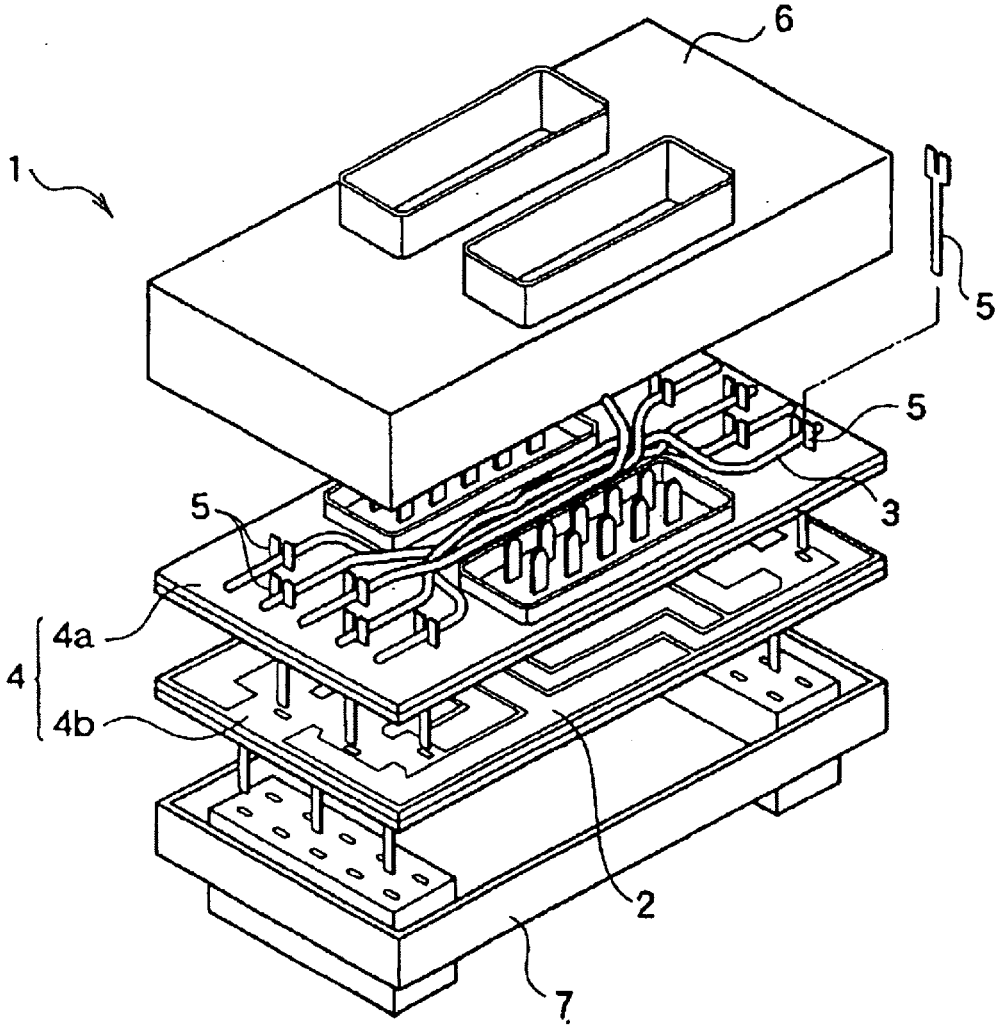
FIG. 12 shows a conventional electric connection box.

FIGS. 9 to 11 show a third embodiment of the invention, and those constituent portions, identical to those of the first and embodiments, will be designated by identical reference numerals, respectively, and repeated description thereof will be omitted. FIG. 9 is a view showing the arrangement of a flat wire extending outwardly from an electric connection box, FIG. 10 is a view explanatory of an additional unit to be connected to an extension portion of the flat wire, and FIG. 11 is a diagram of a circuit branching off from the extension portion of the flat wire. This third embodiment differs mainly from the first and second embodiments in that the flat wire, arranged in the electric connection box, is extended outwardly therefrom, and is used as a wire harness for connection to auxiliary equipments.

As shown in FIG. 9, one end of the first wire harness 20A (arranged in the electric connection box 10, 10*a* of the first or the second embodiment) is extended outwardly from the casing 13 of the electric connection box 10*b*, and this extension portion 23 is so extended that the auxiliary equipments 50 can be connected thereto. The overall construction, including this extension portion 23, is provided as a wire harness module 17.

The auxiliary equipments 50 include a connector 51, connected to a distal end (portion P1) of the extension portion 23, and meters 52 and 52*a* and a switch 53 on an instrument panel, which are connected to intermediate portions (portions P2 and P3) of the extension portion 23. Other auxiliary equipments than these includes the unit 54 (shown in FIG. 10), connected to an intermediate portion (point P4) of the extension portion 23, and a circuit member 55 (shown in FIG. 11) branching off from the intermediate portion P2 of the extension portion 23.

In this embodiment, the extension portion 23 of the first flat wire harness 20A is thus connected to the auxiliary equipments 50. Usually, connection between the casing 13 and each auxiliary equipment is made through wires and a connector. However, thanks to the provision of the extension portion 23, the use of such wires and connector can be omitted, and the overall construction, including the auxiliary equipments 50, can be simplified. And besides, each of the auxiliary equipments 50 can be connected to an arbitrary portion of the extension portion 23, and therefore the layout of these auxiliary equipments can be effected easily.

In this embodiment, although the first flat wire 20A has the extension portion 23, such an extension portion can be provided at the second wire harness 20B, depending on the circuit construction, and the auxiliary equipment can be connected to this extension portion. And besides, the extension portion 23 can be formed by other wire (e.g. a single conductor wire or an enameled wire) than the flat wire.

INDUSTRIAL APPLICABILITY

In the electric connection box circuit member-arranging method of the invention, the plurality of flexible flat circuit members, each including the plurality of conductors covered with the covering member, are overlapped to form the wiring structure of the internal equipment portion, and therefore the use of wiring boards can be omitted, and the multi-layer circuit construction can be provided easily, and can be simplified. The plurality of overlapped flat circuit members intersect each other, and therefore the electric parts, connected to the ends of the flat circuit members, are spaced from one another in the peripheral direction around the intersecting portions, so that the layout of the electric parts can be effected easily. And besides, the flexible flat circuit members intersect each other, and are flexible, and these flat circuit members, having the electric parts connected thereto, are curled and inserted into the casing, and therefore this inserting operation can be effected easily. Thus, the circuit construction of the internal equipment portion is simplified, and therefore the operation for overlapping the flat circuit members, the operation for connecting the electric parts, and the operation for inserting the internal equipment portion into the casing can be effected easily not only by the assembling apparatus but also by a manually-assembling operation.

In the electric connection box circuit member-arranging method of the invention, the arbitrary conductors of the overlapped flat circuit members are directly connected together at their intersecting portions, and therefore there is no need to use a connector and connection terminals at these connecting portions, and this connecting operation can be effected rapidly and positively, so that the efficiency of production of the circuit can be enhanced.

In the electric connection box circuit member-arranging method of the invention, the press-connecting terminals are fixedly secured to each of the electric parts, and the conductors of the flat circuit members are press-connected to the press-connecting terminals. Therefore, the connection between the flat circuit member and the electric part can be made merely by press-connecting the conductors of the flat circuit member to the press-connecting terminals, and this connecting operation can be effected easily and positively, so that the productivity can be enhanced.

In the electric connection box circuit member-arranging structure of the invention, the flexible flat circuit members, are overlapped to provide the wiring structure of the internal equipment portion, and therefore the use of wiring boards can be eliminated. The plurality of overlapped flat circuit members intersect each other, and by doing so, the layout of the electric parts, connected to the ends of these flat circuit members, can be effected easily. And besides, the flexible flat circuit members, having the electric parts connected thereto, can be easily curled and inserted into the casing, so that the compact design of the overall construction can be achieved. Furthermore, the electric parts are beforehand provided at the mounting holes and retaining portions of the casing, and the fixing of these electric parts can be effected easily even by a manually-assembling operation, and therefore the installed apparatus can be simplified. Furthermore, since the wiring structure is formed by the flat circuit members, the arbitrary circuit can be easily changed according to a program.

In the electric connection box circuit member-arranging structure of the invention, the plurality of flexible flat circuit members are overlapped, and therefore the multi-layer circuit construction can be simplified. The overlapped flexible flat circuit members intersect each other, and are curled and inserted into the casing, so that the compact design of the overall construction can be achieved. The arbitrary end of the flat circuit member is extended outwardly from the casing to the auxiliary equipment which is to be connected to this extension portion, and therefore the use of wires, connecting the casing to the auxiliary equipment, and the use of a connector, connecting these wires to the casing, are omitted, so that the overall construction, including the auxiliary equipments, can be greatly simplified.

In the electric connection box circuit member-arranging structure of the invention, arbitrary ones of the conductors of the overlapped flat circuit members are connected together at their intersecting portions. Thus, the arbitrary conductors of the overlapped flat circuit members can be directly connected together, and therefore there is no need to use a connector and connection terminals, and the connection structure is simplified, and the connection can be effected positively.

What is claimed is:

1. A method of arranging circuit members of an electric connection box, comprising the steps of:

overlapping a plurality of flexible flat circuit members in intersecting relation to each other, each of said flat circuit members comprising a plurality of conductors which are juxtaposed at predetermined intervals, and are covered with a covering member in an insulating manner;

connecting an electric part to portions of one of said overlapped flat circuit members, and connecting another electric part to portions of another of said overlapped flat circuit members; and curling said flat circuit members and inserting them into a casing while positioning said electric parts on said casing.

2. A method of arranging circuit members of an electric connection box according to claim 1, wherein some of said conductors of said overlapped flat circuit members are connected together at their intersecting portions.

3. A method of arranging circuit members of an electric connection box according to claim 1, further comprising:

press-connecting terminals fixedly secured to each of said electric parts, wherein the conductors of said flat circuit members are press-connected to said press-connecting terminals.

4. A method of arranging circuit members of an electric connection box according to claim 2, further comprising:

press-connecting terminals fixedly secured to each of said electric parts, wherein the conductors of said flat circuit members are press-connected to said press-connecting terminals.

5. A structure of arranging circuit members of an electric connection box comprising:

a plurality of flexible flat circuit members each including a plurality of conductors which are juxtaposed at predetermined intervals, and are covered with a covering member in an insulating manner, and said flat circuit members are overlapped in intersecting relation to each other, and one electric part connected to portions of one of said overlapped flat circuit members, and another electric part connected to portions of another of said flat circuit members, wherein said flat circuit members are curled, and are inserted into a casing while positioning said electric parts on said casing.

6. A structure of arranging circuit members of an electric connection box as claimed in claim 5, wherein one end of each flat circuit member is extended outwardly from said casing, and said extension portion is extended to an auxiliary equipment which is to be connected to said extension portion.

7. A structure of arranging circuit members of an electric connection box according to claim 5, wherein some of said conductors of said overlapped flat circuit members are connected together at their intersecting portions.

8. A structure of arranging circuit members of an electric connection box according to claim 6, wherein some of said conductors of said overlapped flat circuit members are connected together at their intersecting portions.

9. The method of arranging circuit members of an electric connection box according to claim 1, wherein said electric parts are positioned relative to said casing in a direction substantially perpendicular to said electric parts' attachment position with said flat circuit members.

10. The method of arranging circuit members of an electric connection box according to claim 2, wherein said electric parts are positioned relative to said casing in a direction substantially perpendicular to said electric parts' attachment position with said flat circuit members.

11. The method of arranging circuit members of an electric connection box according to claim 3, wherein said electric parts are positioned relative to said casing in a direction substantially perpendicular to said electric parts' attachment position with said flat circuit members.

12. The structure of arranging circuit members of an electric connection box according to claim 5, wherein said electric parts are positioned relative to said casing in a direction substantially perpendicular to said electric parts' attachment position with said flat circuit members.

13. The structure of arranging circuit members of an electric connection box according to claim 6, wherein said electric parts are positioned relative to said casing in a direction substantially perpendicular to said electric parts' attachment position with said flat circuit members.

14. The method of arranging circuit members of an electric connection box according to claim 1, wherein said electric parts are inserted into mounting holes in said casing.

15. The method of arranging circuit members of an electric connection box according to claim 2, wherein said electric parts are inserted into mounting holes in said casing.

16. The method of arranging circuit members of an electric connection box according to claim 3, wherein said electric parts are inserted into mounting holes in said casing.

17. The structure of arranging circuit members of an electric connection box according to claim 5, wherein said electric parts are inserted into mounting holes in said casing.

18. The structure of arranging circuit members of an electric connection box according to claim 6, wherein said electric parts are inserted into mounting holes in said casing.

* * * * *